United States Patent [19]

Schneider et al.

[11] Patent Number: 5,002,229

[45] Date of Patent: Mar. 26, 1991

[54] POWDER SPRAY GUN

[75] Inventors: Douglas A. Schneider, Lorain; Robert Lehky, Huron; Douglas C. Mulder; Rodney L. Ward, both of Wellington, all of Ohio

[73] Assignee: Nordson Corporation, Westlake, Ohio

[21] Appl. No.: 97,946

[22] Filed: Sep. 17, 1987

[51] Int. Cl.[5] ..... B05B 7/14

[52] U.S. Cl. ..... 239/427.5; 239/428; 239/433; 239/600; 239/DIG. 3; 406/94

[58] Field of Search ..... 239/427, 427.3, 427.5, 239/428, 428.5, 429, 433, 600, DIG. 3; 406/93, 94

[56] References Cited

U.S. PATENT DOCUMENTS

| | | | |
|---|---|---|---|
| 955,715 | 4/1910 | Stokes et al. | 239/427.3 |
| 3,768,962 | 10/1973 | Baranowski, Jr. | 239/429 X |
| 4,543,274 | 9/1985 | Mulder | 239/DIG. 3 X |
| 4,600,603 | 7/1986 | Mulder | 239/427.3 X |

FOREIGN PATENT DOCUMENTS

| | | | |
|---|---|---|---|
| 9377 | 10/1908 | France | 239/427.3 |
| 612875 | 11/1926 | France | 239/429 |

OTHER PUBLICATIONS

Vortec Advertisement entitled "Transvector Air Flow Amplifiers".

Vortec Corporation Brochure entitled "A Short Course on Transvector Air Flow Amplifiers with Applications Notes".

Vortec Corporation Brochure Entitled "Blow Off".

*Primary Examiner*—Andres Kashnikow

*Attorney, Agent, or Firm*—Wood, Herron & Evans

[57] ABSTRACT

A powder spray gun comrpises a tubular housing having ambient air flow passages located in the side wall thereof medially of the opposite ends. A pair of air flow amplifiers are mounted in the housing on opposite sides of the ambient air flow passages and are so oriented that compressed air supplied to the upstream one of these amplifiers, the so called suspension amplifier, is operable to draw ambient air into the outlet end of the suspension amplifier, and compressed air supplied to the downstream amplifier, the so called pattern amplifier, is operable to draw ambient air into the inlet end of the pattern amplifier. The amplifiers are secured within the housing by end caps which are sealingly secured onto the ends of the housing by bayonet pin and slot connectors.

23 Claims, 1 Drawing Sheet

POWDER SPRAY GUN

This invention relates to the spraying of solid particulate powder material, and more particularly, to an improved apparatus for spraying solid particulate powder material. This invention is an improvement upon the apparatus disclosed in U.S. Pat. No. 4,600,603 entitled "Powder Spray Apparatus and Powder Spray Method".

In the above-identified patent, there is disclosed a powder spray gun which is characterized by sharp start-up and sharp cutoff of powder flow from the gun. The gun disclosed in that patent is also characterized by a relatively high velocity powder flow from the gun and an even distribution of powder throughout the pattern emitted from the gun. These are all characteristics which are highly desirable for many applications of powder spray equipment.

The powder spray apparatus disclosed in the above-identified patent comprises two series aligned air flow amplifiers, both of which are mounted upon supporting bodies. These bodies are in turn adjustably mounted upon a supporting rod. The upstreammost one of these air flow amplifiers is connected to a source of air-entrained powder, while the downstreammost one of these amplifiers is connected to a powder discharge nozzle. The spacing of the bodies, and thus the spacing between the air flow amplifiers, is adjustable so as to obtain optimal spray patterns and powder velocities from the apparatus in accordance with the needs or requirements for a particular powder spray application.

The powder spray gun of the above-identified patent employs a multiplicity of separate components which are difficult to assemble and disassemble, as for example, for cleaning of the apparatus, and difficult to obtain repeatable flow patterns and velocities after disassembly and reassembly of the components. The equipment is also relatively time consuming to assemble and disassemble.

It has therefore been one objective of this invention to provide an improved powder spray apparatus which employs dual air flow amplifiers as in the above-identified patent, but which has a fewer number of component parts and which may more easily be assembled and disassembled than prior art apparatus of this type.

It has been another objective of this invention to provide a dual amplifier, powder spray apparatus as in the above-identified patent, but which, when assembled, automatically sets the air flow passageway adjustments of the air flow amplifiers so as to achieve repeatability and control of the patterns emitted from the gun.

The invention of this application which achieves these objectives comprises a housing having a generally tubular sidewall and an axial bore extending through the housing, which bore is intersected by at least one ambient air flow passage extending through the sidewall of the housing, a first air flow amplifier mounted in one end of the housing on one side of the ambient air flow passage, and a second air flow amplifier mounted in an opposite end of the tubular housing on an opposite side of the ambient air flow passage from the first air flow amplifier. Both amplifiers include means for directing a stream of compressed air into a powder flow passage of the amplifier so as to draw ambient air through the ambient air flow passage of the housing into the powder discharge opening of the powder flow passage of the first amplifier and into the powder inlet opening of the powder flow passage of the second amplifier. In the preferred embodiment, both amplifiers comprise a two-piece assembly of an amplifier body and an amplifier nozzle. The two-piece assembly of the amplifiers is either threadably assembled or assembled by a bayonet-type pin and slot connector between the two pieces of the amplifier. Both amplifiers are slidably received within mounting bores of the housing and are secured therein by end caps on the housing. In the preferred embodiment of the invention, the end caps are secured onto the end of the housing by bayonet-type pin and slot connectors. O-ring seals between the components of the spray gun maintain a seal between those components, as well as frictionally maintain them in an assembled relationship.

This construction of the powder spray gun of this invention has the advantage of being very compact and of being manufactured from a minimum number of separate components which may be easily and quickly disassembled and reassembled. In the preferred embodiment of the invention, the air flow gaps within the individual air flow amplifiers of the gun are pre-established by fixed air flow gaps within the gun. Thereby, the air flow pattern emitted from the gun is repeatable and easily controlled after disassembly and reassembly of the gun.

These and other objects and advantages of this invention will be more readily apparent from the following description of the drawings in which.

Figure 1:
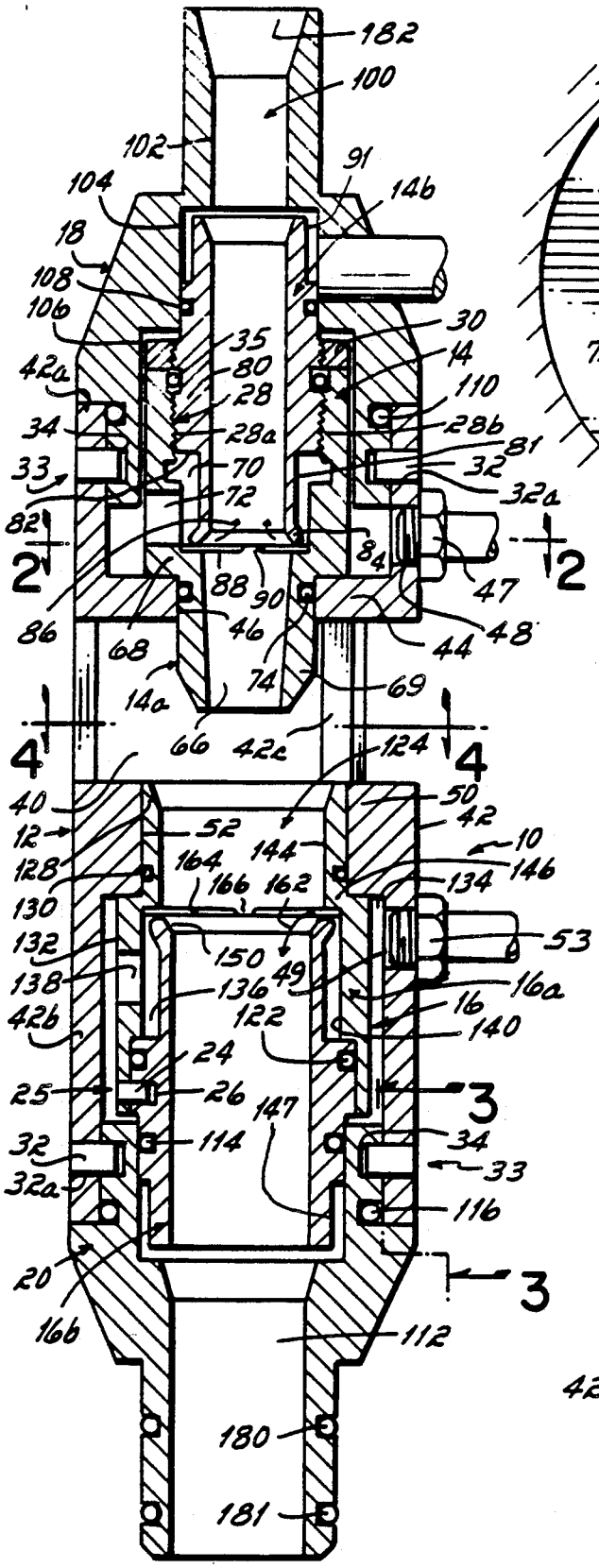
FIG. 1 is a cross-sectional view of a powder spray gun incorporating the invention of this application.

The powder spray gun 10 of this invention comprises a generally cylindrical, tubular housing 12 within which there are located a pair of air flow amplifiers 14 and 16. The housing 12 and amplifiers 14 and 16 are so constructed that the amplifiers may be simply slipped into the housing and retained therein by top and bottom mounting caps 18 and 20, respectively.

Each air flow amplifier 14 and 16 comprises a two-piece assembly, a body **14*a*, 16*a* and a nozzle 14*b*, 16*b*. In the illustrated embodiment, the lower air flow amplifier 16, the so-called "pattern" amplifier, is assembled by a bayonet-type pin 24 and slot 26 connector 25. The other amplifier 14, the so-called "suspension" amplifier, may be assembled by a bayonet-type pin and slot connector, but in the illustrated embodiment, it is assembled by means of a threaded connection 28 between the two-pieces 14*a*, 14*b* of the amplifier 14. In the case of the upper amplifier 14, which is assembled by means of a threaded connector 28, a lock-nut 30 is optionally threaded onto the nozzle assembly so as to lock the two-piece air flow amplifier 14** in an assembled relationship.

Figure 3:
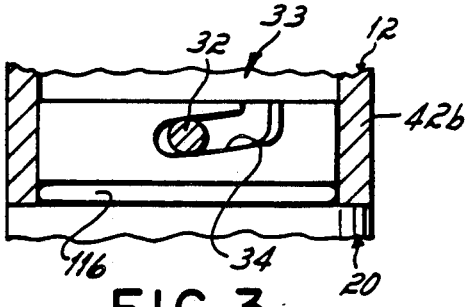
FIG. 3 is a cross-sectional view taken on line 3—3 of FIG. 1.

Both the top and bottom caps 18 and 20 are assembled onto the housing by bayonet-type pin 32 and slot 34 connectors 33. With reference particularly to FIG. 3, it will be seen that these connectors each comprise a pair of generally L-shaped slots 34 machined into the peripheral surface of the caps 18, 20 and adapted to receive pins 32 fixedly mounted in the housing 12. These pin and slot connectors 33 enable the caps to be very quickly assembled onto the housing or very quickly disassembled therefrom.

It will now be readily apparent that the complete gun, including the housing 12, two two-piece air amplifiers 14 and 16, and the top and bottom caps 18 and 20 comprise only a seven-piece assembly if both amplifiers are assembled by bayonet-type pin and slot connectors or eight pieces if the lock nut 30 is included in a threaded type amplifier. As is explained more fully hereinafter, this seven (or eight) piece assembly may very quickly be assembled and disassembled so as to facilitate cleaning of the gun. This assembly is also very compact and, as explained more fully hereinafter, requires no adjustment of the amplifiers or of any other component of the gun once it has been assembled.

The Housing

Figure 4:
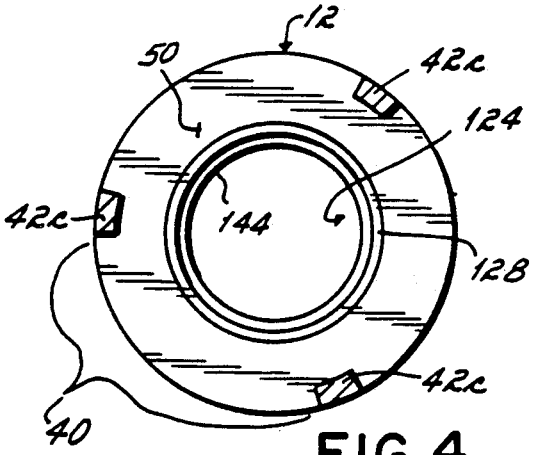
FIG. 4 is a cross-sectional view taken on line 4—4 of FIG. 1.

The housing 12 of the gun is configured as a cylindrical sleeve. This sleeve has three large apertures 40 machined from the side wall thereof. As a consequence of these apertures, the upper section **42*a* of the side wall 42 is separated from the lower section 42*b* by three equidistantly spaced, vertically extending posts 42*c* (see FIG. 4**).

Located immediately above the posts **42*c* of the housing side wall 42 there is a flange 44 which extends inwardly from the side wall of the housing. This flange has an axial bore 46 formed therein, which bore receives the lower end of the suspension amplifier 14. Located immediately above the flange 44 there is a threaded port 48, which port receives a conventional threaded air fitting 47. The fitting is, in the use of the gun 10**, connected to a source of compressed air (not shown).

Located immediately below the posts **42*c* there is another internal flange 50 which extends into the interior of the housing from the side wall 42. This flange also has an axial bore 52 for the reception of the pattern amplifier 16**.

A threaded port 49, similar to port 48, is located immediately below the flange 50 of the housing. This port extends through the side wall 42 and receives a conventional compressed air fitting 53 through which compressed air is supplied to the gun 10.

Extending inwardly into the interior of the tubular housing 12 adjacent the top and bottom ends thereof, there are a pair of pins 32 of the bayonet-type pin and slot connectors 33. These pins 32 are preferably press fit into holes **32*a* machined into the side walls 42 of the housing. As mentioned hereinabove, these pins are adapted to be received within slots 34 machined into the top and bottom caps 18 and 20**, respectively, so as to enable those caps to be removably secured to the housing.

Suspension Amplifier

The suspension amplifier 14 comprises a body **14*a* and a nozzle 14*b*. The two pieces, the nozzle 14*b* and body 14*a*, are both generally tubular in configuration and are retained in an assembled relationship with the nozzle contained internally of the body by the threaded connection 28. This connection comprises external threads 28*a* on the periphery of the nozzle 14*b* and internal threads 28*b* on the interior of the body 14*a***.

The body **14*a* has an axial bore 66 extending therethrough. This bore is of larger diameter at the upper end and smaller diameter at the lower end. Between the two different diameter sections there is a shoulder 68. Additionally, there is an annular channel 70 around the interior of the bore 66 adjacent the intersection of the threaded and unthreaded sections of the upper large diameter portion of the bore. Between the annular channel 70 and the shoulder 68 there is a radial hole 72 through which compressed air may pass from the exterior to the interior of the body 14*a***.

The lower end of the body **14*a* is slidably received within the bore 46 of the housing 12. An O-ring 74 located within an annular groove in the periphery of the body forms a seal between the body 14*a* and the bore 46**.

From the shoulder 68 in the body to the lower end, the bore 66 tapers inwardly and downwardly. This taper functions to focus air-entrained powder passing through the amplifier 14 into the open upper end of the lower pattern air flow amplifier 16.

The nozzle **14*b* of the suspension amplifier 14 is provided with a peripheral flange 80 upon which the threads 28*a* are formed. Below this flange 80 there is a section of reduced diameter 81 separated from the threaded section 80 by a shoulder 82. The reduced diameter section 81 terminates in an outwardly flared lower end 84 of the nozzle. This outwardly flared lower end 84 of the nozzle abuts the shoulder 68 of the body 14*a***.

Figure 2:
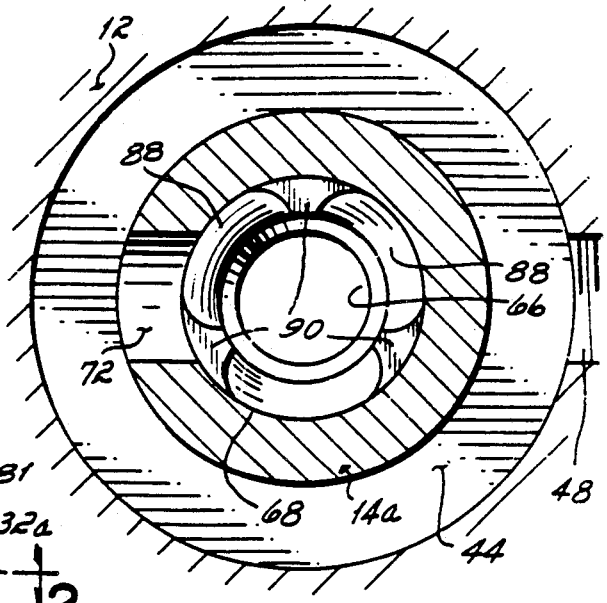
FIG. 2 is a cross-sectional view taken on line 2—2 of FIG. 1.

As may be seen most clearly in FIGS. 1 and 2, the shoulder 68 of the body forms a seat for the lower flared end 84 of the nozzle **14*b*. To facilitate air flow, as indicated by the arrow 86, over this seat, there are recesses 88 machined from the shoulder 68. As a result of these recesses being machined or formed in shoulder 68, the shoulder comprises three raised sections or ribs 90 against which the lower end 84 of the nozzle 14*b* abuts, with the recesses 88 being located between the ribs. To facilitate assembly and disassembly of the suspension amplifier, it preferably has flats 91 formed or machined on the upper end of the nozzle 14*b***.

Pattern Amplifier 16

The lower or pattern amplifier 16 comprises the nozzle **16*a* and body 16*b*. Both the body 16*a* and nozzle 16*b* are generally cylindrical in configuration. The nozzle of the amplifier 16 is secured to the body by a bayonet-style pin and slot connection 25 substantially identical to the pin and slot connectors 33 (FIG. 3) which connect the top and bottom caps to the housing. This connection 25 comprises a pin 24 which is received within a generally L-shaped slot 26 of the nozzle so as to secure the two pieces in an assembled relation. An O-ring 122 contained within an annular groove of the nozzle seals the periphery of the nozzle relative to the interior bore 124 of the body 16*a***.

The body **16*a* has a smaller diameter upper end section 128 which is received within the bore 52 of the housing 12. The exterior surface of this section of the body is sealed relative to the bore 52 by an O-ring 130 mounted within an annular groove in the surface of the upper end section 128 of the body. The lower larger diameter section 132 of the body is received within the bore of the housing, but is spaced from the interior surface thereof so as to define an annular channel 134 therebetween. This channel 134 functions as an air flow passage, as explained more fully hereinafter, for the flow of compressed air to the air flow amplifier 16. The annular channel 134 communicates with an interior channel 136 on the inside of the body by means of a hole 138** in the side wall of the housing.

Between the large diameter lower end section 140 of the bore 124 and the smaller diameter upper end section 144 of that bore there is a shoulder 146. The upper end of the nozzle **16*b*** rests against this shoulder.

The nozzle 16b is also tubular in configuration and has an axial bore 147 extending therethrough. At its upper end, the side wall of the nozzle is flared outwardly, as indicated at 150. The upper end of this flared end wall rests against the shoulder 146 of the body. In order for air to flow from the annular channel 136 around the flared end 150 of the nozzle, as indicated by the arrow 162, there are recesses 164 machined from the surface of the shoulder 146. These recesses are identical in configuration to the recesses 88 in the shoulder 68 of the upper suspension amplifier 14. These recesses define ridges 166 therebetween against which the upper end of the nozzle abuts. Consequently, compressed air is free to flow from the channel 136 through the recesses 164 machined from the shoulder 146 and into the interior of the nozzle.

As in the case of the suspension amplifier, the pattern amplifier 16 preferably has flats 147 machined or formed on the lower end of the nozzle 16b to facilitate assembly or disassembly of the nozzle by engagement of the flats with a wrench.

Top and Bottom Caps

The top cap 18 functions to retain the suspension amplifier 14 assembled within the housing 12. To that end, the generally tubular-shaped top cap has an axial bore 100 extending therethrough. This bore has a small diameter upper end section 102, a larger diameter intermediate section 104, and a large diameter lower end section 106. The small diameter upper end section 102 of the cap is adapted to be placed in fluid communication with a source of air-entrained powder. The intermediate diameter section 104 fits over the upper end of the nozzle 14b of amplifier 14 and is sealed relative thereto by an O-ring seal 108 located within an annular channel in the periphery of the nozzle. The large diameter section 106 of the bore of the cap is received over the upper end of the body 14a of the amplifier 14. The lower end of the top cap 18 has a pair of generally L-shaped bayonet slots 34 (See FIG. 3), which receive the pins 32 in the upper end of the housing 12. When the top cap is mounted onto the top of the housing and rotated relative thereto, the pin 32 slides in the slot 34 and functions to clamp the top cap to the top end of the housing. An O-ring seal 110 contained within a groove in the periphery of the top cap seals the top cap relative to the housing, and in cooperation with the pin and slot connector 33, locks the top cap to the top of the housing.

The lower or pattern amplifier 16 is retained within the housing 12 by the bottom cap 20. This cap is also tubular in configuration and has an axial bore 112 extending therethrough. The lower small diameter end section of this bore is adapted to be placed in fluid communication with a powder spray nozzle (not shown). The upper large diameter end section of this bore 112 is received over the lower end of the amplifier nozzle 16b and is sealed relative thereto by the O-ring 114. Another O-ring 116 mounted in an annular groove in the periphery of the bottom cap 20 seals the exterior of the bottom cap relative to the interior of the housing 12. This lower O-ring seal 116 cooperates with the pin and slot connector 33 to retain the bottom cap in an assembled relation on the housing with the bottom amplifier 16 contained interiorly thereof.

Assembly

The powder spray gun 10 is assembled by first assembling the suspension amplifier 14. This is accomplished by threading the nozzle 14b of the amplifier 14 into the body 14a until the end surface of the flared end 84 of the nozzle engages the top surface of the ridges 90 on the shoulder 68. With the nozzle and body so assembled, the locknut 30 is threaded onto the upper end of the nozzle until the bottom surface of the locknut engages the top surface of the body 14a. An O-ring 35 contained within an annular groove of the nozzle then forms an air seal between the nozzle 14b and body 14a. With the top cap 18 removed from the housing 12, the assembled suspension nozzle 14 is then dropped into the housing. The lower end, or so-called "nozzle" end of the body, then slides through the axial bore 46 of the housing until a shoulder-defined between the lower end of the body 14a and the upper end contacts the top surface of the flange 44. The O-ring 74 then forms an air seal between the body 14a and the flange 44 of the housing. The top cap 18 of the gun is then placed over the top of the housing and over the top of the amplifier 14. The bayonet slots 34 of the top cap then slip over the pins 32 such that when the top cap is then rotated, the top cap clamps the amplifier 14 on the interior of the housing. The O-ring seal 110 then cooperates with the bayonet pin and slot connector 33 so as to fixedly secure the top cap to the top of the housing. The O-ring seal 108 then forms a seal between the nozzle of the amplifier and the bore of the top cap.

The lower or pattern amplifier 16 is next assembled by placing the nozzle 16b within the body 16a. The nozzle and body are then secured together by locating the pin 24 within the slot 26 of the nozzle and rotating the nozzle relative to the body. This bayonet slot connection 25 then secures the nozzle within the body with the O-ring seal 122 then forming a seal between the nozzle and body. When the nozzle and body are secured together by the pin and bayonet slot connection, the upper end of the nozzle 166 rests against the bottom surface of the ridges or ribs 166 of the shoulder 146.

The pattern amplifier 16 is then inserted into the housing 12 with the upper end of the body 16a of the amplifier received within the bore 52 of the housing. The O-ring seal 130 then forms an air seal between the bore 52 of the housing and the upper end of the body 16a. The amplifier 16 is then secured within the housing by placement of the bottom cap 20 over the lower end of the nozzle of the amplifier 16. The slots 34 of the bottom cap 20 are then inserted over the pins 32 and the bottom cap rotated so as to secure the bottom cap to the lower end of the housing with the O-ring seal 116 compressed therebetween. The O-ring 114 then forms a seal between the exterior of the amplifier and the interior bore of the bottom cap.

Operation

In the use of the gun 10, a powder spray nozzle (not shown) is placed over the bottom tubular end section 112 of the bottom cap. The nozzle is generally frictionally secured to the lower end of the bottom cap by O-rings 180, 181 mounted in annular grooves in the peripheral surface of the bottom cap.

In the use of the spray gun, compressed air is supplied to the air fittings 47, 53 mounted in each of the threaded bores 48 and 49 of the housing 12. Compressed air supplied to the fitting 47 passes through an annular channel contained interiorly of the housing 12, through the bore 72, into the channel 70 located internally of the amplifier 14. From this channel, the compressed air passes through the recesses 88 defined between the bottom surface of the end of the nozzle and the top surface of the shoulder of the nozzle body. This compressed air, then, is generally directed upwardly when it emerges from the recesses 88. Because it is so directed, it creates a vacuum in the lower end of the nozzle body 14*a* which tends to draw ambient air from the exterior of the housing, through the apertures 40, into the interior of the housing and into the lower end of the amplifier 14.

Compressed air, at a pressure usually substantially greater than that supplied to the fitting 47 and threaded port 48, is also supplied to the fitting 53 and port 49. This compressed air passes through the annular channel 134 defined between the interior of the housing and the exterior of the amplifier body 16*a*, through the aperture 138 in the amplifier body, and into the annular channel 136. From this channel 136 the air passes upwardly around the upper flared end of the nozzle through the recesses 164 and downwardly into the axial center bore of the nozzle. This high pressure air draws ambient air through the passages 40 of the housing downwardly into the open upper end of the amplifier 16.

While compressed air is supplied to the threaded air inlet ports 48 and 49, air-entrained powder is supplied to the inlet port 182 of the top cap 18. This air-entrained powder flows downwardly through the suspension amplifier 14. Within this suspension amplifier, the air-entrained powder is subjected to turbulence created by the upwardly directed compressed airstream flowing through the recesses 88 of the amplifier. This air-entrained powder passes through the suspension amplifier and is focused and directed by the lower discharge nozzle end 69 of the amplifier body 14*a* of the suspension amplifier into the open upper end of the lower pattern amplifier 16. In the course of passage through the pattern amplifier, the velocity of the powder is increased by the high velocity, downwardly directed airstream emitted through the recesses 164 of the pattern amplifier. This high velocity airstream causes a vacuum to be drawn at the inlet to the pattern amplifier 16 so as to pull ambient air into the amplifier from the surrounding air through the passages 40 of the housing. Simultaneously, the high velocity air flow through the lower pattern amplifier draws air-entrained powder from the upper suspension amplifier 14. In the course of passage through the pattern amplifier, the velocity of the powder is markedly increased. The high velocity powder is then caused to flow from the gun via the discharge passage 112 in the bottom cap 20.

When air-entrained powder flow to the inlet port 182 of the gun is terminated, air flow to the suspension amplifier via the high pressure inlet port 48 is maintained. By maintaining air flow to the upper suspension amplifier, any powder contained in the lines above the discharge end of the suspension amplifier is either maintained in the lines or purged from the lines back into the powder source or supply. As a result, powder flow does not continue to trickle from the gun or to blow out of the ambient air flow passages 40 of the gun. Instead, powder flow is sharply cut off when powder flow to the inlet 182 of the gun is terminated. When powder flow is again initiated to the inlet port 182 of the gun, powder flow is sharply initiated as a consequence of the air flow being maintained to both the suspension amplifier and the pattern amplifier 16.

The powder spray gun 10 of this invention has numerous advantages over the spray gun upon which it is an improvement, i.e., that gun disclosed in U.S. Pat. No. 4,600,603. Specifically, the gun disclosed herein is more compact and has fewer parts required to be disassembled for cleaning. This gun also is so assembled that it may be very easily and quickly disassembled and then reassembled. The connection of the gun parts by bayonet-type pin and slot connectors in combination with O-ring seals enables the gun to be very quickly assembled.

Yet another advantage of this gun is that is has fixed gaps established by the recesses 88 and 164 between the end of the nozzle amplifiers and the nozzle body. These fixed gaps, through which high pressure air is injected into the amplifiers, facilitate repeatability in the pattern sprayed from the gun and prevent operators from changing the adjustment of the gun such that it operates at less than optimal conditions.

The gun of this invention is also characterized by focused flow of the powder from the upper suspension amplifier into the lower pattern amplifier. This focused flow derives from the provision of a nozzle of the suspension amplifier extending downwardly into close, but spaced, proximity with the inlet to the lower pattern amplifier. Thereby, bounce-back of powder from the lower pattern amplifier and the escape of powder or dust through the ambient air passages 40 of the housing is minimized or eliminated.

Yet another advantage of the construction of the gun described hereinabove over the gun described in the assignee's above-identified patent, No. 4,600,603, is that this gun, because of its connection of the air fittings 47, 53 directly to the housing 12, rather than to the amplifiers as in the above-identified patent, facilitates disassembly of the gun and the nozzles without any need to disconnect the air lines from the fittings or the fittings from the housing. Thereby, the time required to disassemble and reassemble the gun and the amplifiers for cleaning or repair is greatly reduced. Additionally, because the fittings and/or hoses do not have to be tampered with during disassembly of the gun, the life expectancy of the fittings and hoses is significantly increased.

While we have described only a single preferred embodiment of this invention, persons skilled in the art to which it pertains will appreciate numerous changes and modifications which may be made without departing from the spirit of our invention. Therefore, we do not intend to be limited except by the scope of the following appended claims:

We claim:

1. A powder spray gun comprising a housing having a generally tubular sidewall and an axial bore extending through said housing, said bore being intersected by at least one ambient air flow passage extending through the sidewall of said housing, a first air flow amplifier releasably mounted within and supported by one end of said tubular housing on one side of said ambient air flow passage, said first air flow amplifier having a powder flow passage extending axially therethrough, said first powder flow amplifier having a powder inlet opening at one end of said powder flow passage and a powder discharge opening at the other end of said powder flow passage, means including a first air fitting mounted in said housing independently of said first amplifier for directing a stream of compressed air into said powder flow passage of said first amplifier so as to draw ambient air through said ambient air flow passage of said housing into said powder discharge opening of said powder flow passage of said first amplifier, and a second air flow amplifier releasably mounted within and supported by an opposite end of said tubular housing on an opposite side of said ambient air flow passage from said first air flow amplifier, said second air flow amplifier having a powder flow passage extending axially therethrough, said second air flow amplifier having a powder inlet opening at one end of said powder flow passage and a powder discharge opening at the other end of said powder flow passage, means including a second air fitting mounted in said housing independently of said second amplifier for directing a stream of compressed air into said powder flow passage of said second amplifier so as to draw ambient air through said ambient air flow passage of said housing into the powder inlet opening of said powder flow passage of said second air flow amplifier.

2. The powder spray gun of claim 1 in which each of said first and second amplifiers comprises a two-piece assembly of an amplifier body and an amplifier nozzle.

3. The powder spray gun of claim 2 wherein at least one of said amplifier nozzles is attached to said amplifier body by having external threads threaded into internal threads of said amplifier body.

4. The powder spray gun of claim 2 wherein at least one of said amplifier nozzles is attached to said amplifier body by a bayonet-type pin and slot connector.

5. The spray gun of claim 2 wherein one end of each of said amplifier nozzles abuts a shoulder of one of said amplifier bodies, each of said shoulders having multiple grooves formed therein through which said stream of compressed air is directed into said powder flow passages.

6. The spray gun of claim 2 wherein said body of said first amplifier has a discharge nozzle surrounding the discharge end of said powder flow passage of said first amplifier, and said body of said second amplifier having a tubular section extending toward and into close adjacency with the discharge nozzle of said first amplifier body so as to minimize bounce-back of powder moving from said first amplifier into said second amplifier.

7. A powder spray gun comprising a housing having a generally tubular sidewall and an axial bore extending through said housing, said bore being intersected by at least one ambient air flow passage extending through the sidewall of said housing, a first air flow amplifier releasably mounted within and supported by one end of said tubular housing on one side of said ambient air flow passage, said first air flow amplifier having a powder flow passage extending axially therethrough, said first powder flow amplifier having a powder inlet opening at one end of said powder flow passage and a powder discharge opening at the other end of said powder flow passage, means for directing a stream of compressed air into said powder flow passage of said first amplifier so as to draw ambient air through said ambient air flow passage of said housing into said powder discharge opening of said powder flow passage of said first amplifier.

a second air flow amplifier releasably mounted within and supported by an opposite end of said tubular housing on an opposite side of said ambient air flow passage from said first air flow amplifier, said second air flow amplifier having a powder flow passage extending axially therethrough, said second air flow amplifier having a powder inlet opening at one end of said powder flow passage and a powder discharge opening at the other end of said powder flow passage, means for directing a stream of compressed air into said powder flow passage of said second amplifier so as to draw ambient air through said ambient air flow passage of said housing into the powder inlet opening of said powder flow passage of said second air flow amplifier, and said first and second amplifiers being slidably received within mounting bores of said housing and being retained within said mounting bores by end caps secured onto opposite ends of said housing by bayonet-type pin and slot connectors.

8. The powder spray gun of claim 7 wherein an O-ring seal is operatively associated with each of said pin and slot connectors.

9. A powder spray gun comprising a generally cylindrical housing having a generally tubular sidewall and an axial bore extending vertically through said housing, said bore being intersected by at least one ambient air flow passage extending through the sidewall of said housing, a first air flow amplifier releasably mounted within and supported by the upper end of said tubular housing above said ambient air flow passage, said first air flow amplifier having a powder flow passage extending axially therethrough, said first powder flow amplifier having a powder inlet opening at the upper end of said powder flow passage and a powder discharge opening at the lower end of said powder flow passage, means including a first air fitting mounted in said housing independently of said first amplifier for directing a stream of compressed air into said powder flow passage of said first amplifier so as to draw ambient air through said ambient air flow passage of said housing into the lower powder discharge opening of said first amplifier, and a second air flow amplifier releasably mounted within and supported by the lower end of said tubular housing below said ambient air flow passage of said housing, said second air flow amplifier having a powder flow passage extending axially therethrough, said second air flow amplifier having a powder inlet opening at the upper end of said powder flow passage and a powder discharge opening at the lower end of said powder flow passage, means including a second air fitting mounted in said housing independently of said second air amplifier for directing a stream of compressed air into said powder flow passage of said second amplifier so as to draw ambient air through said ambient air flow passage of said housing into the upper powder inlet opening of said second air flow amplifier.

10. The powder spray gun of claim 9 in which each of said first and second amplifiers comprises a two-piece assembly of an amplifier body and an amplifier nozzle.

11. The powder spray gun of claim 10 wherein at least one of said amplifier nozzles is attached to said amplifier body by having external threads threaded into internal threads of said amplifier body.

12. The powder spray gun of claim 10 wherein at least one of said amplifier nozzles is attached to said amplifier body by a bayonet-type pin and slot connector.

13. The spray gun of claim 10 wherein one end of each of said amplifier nozzles abuts a shoulder of one of said amplifier bodies, each of said shoulders having multiple grooves formed therein through which said stream of compressed air is directed into said powder flow passages.

14. The spray gun of claim 10 wherein said body of said first amplifier has a discharge nozzle section extending from the lower end thereof, and said body of said second amplifier having a tubular section extending upwardly above the upper end of said nozzle of said second amplifier into close adjacency with the lower end of said discharge nozzle section of said first amplifier body so as to minimize bounce-back of powder moving from said first amplifier into said second amplifier.

15. The powder spray gun of claim 9 wherein said first and second amplifiers are slidably received within mounting bores of said housing and are retained within said mounting bores by top and bottom caps secured onto top and bottom ends of said housing.

16. A powder spray gun comprising a generally cylindrical housing having a generally tubular sidewall and an axial bore extending vertically through said housing, said bore being intersected by at least one ambient air flow passage extending through the sidewall of said housing, a first air flow amplifier releasably mounted within and supported by the upper end of said tubular housing above said ambient air flow passage, said first air flow amplifier having a powder flow passage extending axially therethrough, said first powder flow amplifier having a powder inlet opening at the upper end of said powder flow passage and a powder discharge opening at the lower end of said powder flow passage, means for directing a stream of compressed air into said powder flow passage of said first amplifier so as to draw ambient air through said ambient air flow passage of said housing into the lower powder discharge opening of said first amplifier, a second air flow amplifier releasably mounted within and supported by the lower end of said tubular housing below said ambient air flow passage of said housing, said second air flow amplifier having a powder flow passage extending axially therethrough, said second air flow amplifier having a powder inlet opening at the upper end of said powder flow passage and a powder discharge opening at the lower end of said powder flow passage, means for directing a stream of compressed air into said powder flow passage of said second amplifier so as to draw ambient air through said ambient air flow passage of said housing into the upper powder inlet opening of said second air flow amplifier, said first and second amplifiers being slidably received within mounting bores of said housing and being retained within said mounting bores by top and bottom caps secured onto top and bottom ends of said housing, and said top and bottom caps being secured onto said top and bottom ends of said housing by bayonet-type pin and slot connectors.

17. The powder spray gun of claim 16 wherein an O-ring seal is operatively associated with each of said pin and slot connectors.

18. An air flow amplifier for use in connection with a powder spray gun, which gun includes a housing having a powder flow passage extending axially therethrough, said powder flow passage having an inlet at one end for receiving air entrained powder, and an exit at the opposite end for exhausting air entrained powder, said air flow amplifier being adapted to be received within said powder spray gun housing, said air flow amplifier having an air flow passage extending axially therethrough and adapted to be colinearly aligned with the axis of said powder flow passage of said housing, said amplifier having an inlet open to ambient air at one end of said air flow passage and an air discharge opening at the other end of said air flow passage, means for directing a stream of compressed air into said air flow passage of said amplifier so as to draw ambient air into said air flow passage through said inlet opening, said amplifier comprising a generally tubular two-piece assembly of an amplifier body and an amplifier nozzle, said amplifier nozzle having one end abutting a shoulder of said amplifier body, and one of said one end of said amplifier nozzle or said shoulder of said amplifier body having multiple grooves formed therein through which said stream of compressed air is directed into said air flow passage.

19. The air flow amplifier of claim 18 wherein said amplifier nozzle is attached to said amplifier body by threads of said amplifier nozzle being threaded into threads of said amplifier body.

20. The powder spray gun of claim 18 wherein said amplifier nozzle is attached to said amplifier body by a bayonet-type pin and slot connector.

21. The air flow amplifier of claim 18 wherein at least said amplifier nozzle is attached to said amplifier body by threads of said amplifier nozzle being threaded into threads of said amplifier body.

22. The powder spray gun of claim 18 wherein said amplifier nozzle is attached to said amplifier body by a bayonet-type pin and slot connector.

23. An air flow amplifier having an air flow passage extending axially therethrough, said amplifier having an ambient air inlet opening at one end of said air flow passage and an air discharge opening at the other end of said air flow passage, means for directing a stream of compressed air into said air flow passage of said amplifier so as to draw ambient air into said air flow passage through said inlet opening, said amplifier comprising a generally tubular two-piece assembly of an amplifier body and an amplifier nozzle, said amplifier nozzle having one end abutting a shoulder of said amplifier body, and one of said one end of amplifier nozzle or said shoulder of said amplifier body having multiple grooves formed therein through which said stream of compressed air is directed into said air flow passage.

* * * * *